US010071898B2

(12) United States Patent
Zemko

(10) Patent No.: US 10,071,898 B2
(45) Date of Patent: Sep. 11, 2018

(54) MULTIPLE FLAVOR BEVERAGE DISPENSER

(71) Applicant: Cornelius, Inc., St. Paul, MN (US)

(72) Inventor: Christopher F. Zemko, Elgin, IL (US)

(73) Assignee: Comedlius, Inc., St. Paul, MN (US)

( * ) Notice: Subject to any disclaimer, the term of this patent is extended or adjusted under 35 U.S.C. 154(b) by 74 days.

(21) Appl. No.: 15/094,176

(22) Filed: Apr. 8, 2016

(65) Prior Publication Data

US 2016/0297663 A1 Oct. 13, 2016

Related U.S. Application Data

(60) Provisional application No. 62/145,954, filed on Apr. 10, 2015.

(51) Int. Cl.

| | |
|---|---|
| ***B67D 1/00*** | (2006.01) |
| ***B67D 1/08*** | (2006.01) |
| ***B67D 1/07*** | (2006.01) |
| *B67D 1/12* | (2006.01) |

(52) U.S. Cl.

CPC ..... *B67D 1/0028* (2013.01); *B67D 1/07* (2013.01); *B67D 1/0888* (2013.01); *B67D 1/0044* (2013.01); *B67D 1/1272* (2013.01)

(58) Field of Classification Search

CPC ..... B67D 1/0027; B67D 1/0028; B67D 1/07; B67D 1/075; B67D 1/0044; B67D 1/0043; B67D 1/0042

See application file for complete search history.

(56) References Cited

U.S. PATENT DOCUMENTS

| | | | |
|---|---|---|---|
| 3,575,352 | A | 4/1971 | Hall et al. |
| 4,218,014 | A | 8/1980 | Tracy |
| 4,792,402 | A | 12/1988 | Fricker |
| 4,967,932 | A | 11/1990 | Wiley et al. |
| 5,203,474 | A | 4/1993 | Haynes |
| 5,308,631 | A | 5/1994 | Anglerot |
| 5,649,644 | A | 7/1997 | Hashimoto et al. |
| 6,047,859 | A | 4/2000 | Schroeder et al. |

(Continued)

FOREIGN PATENT DOCUMENTS

| | | | |
|---|---|---|---|
| GB | 2 340 415 | A | 2/2000 |
| WO | 9927070 | A1 | 6/1999 |

(Continued)

OTHER PUBLICATIONS

International Search Report and Written Opinion issued in corresponding International Application No. PCT/US2016/026727, dated Jul. 5, 2016.

*Primary Examiner* — J. Casimer Jacyna
(74) *Attorney, Agent, or Firm* — Andrus Intellctual Property Law, LPP

(57) ABSTRACT

A beverage dispenser and methods of beverage dispensing include a dispenser with a beverage valve and a purge valve. The beverage valve is connected the dispenser body and is actively operable to control a flow of a base beverage into a flow path of the dispenser. The purge valve is selectively operable to control a flow of a purge substance into the flow path. A nozzle is configured to mix a flavoring from a flavoring nozzle with a base beverage from the beverage valve prior to dispensing a mixture of the flavoring and the base beverage from the nozzle.

12 Claims, 10 Drawing Sheets

(56) References Cited

U.S. PATENT DOCUMENTS

| | | | | |
|---|---|---|---|---|
| 6,253,963 | B1 | 7/2001 | Tachibana | |
| 6,698,229 | B2 | 3/2004 | Renken et al. | |
| 6,719,175 | B2 | 4/2004 | Mackenzie et al. | |
| 6,745,592 | B1 | 6/2004 | Edrington et al. | |
| 7,159,743 | B2 | 1/2007 | Brandt et al. | |
| 7,243,818 | B2 | 7/2007 | Jones | |
| 7,445,133 | B2 | 11/2008 | Ludovissie et al. | |
| 7,757,896 | B2 | 7/2010 | Carpenter et al. | |
| 7,878,370 | B2 | 2/2011 | Sevcik et al. | |
| 8,091,737 | B2 | 1/2012 | Smeller et al. | |
| 8,167,173 | B1 | 5/2012 | Simmonds et al. | |
| 8,245,629 | B2 | 8/2012 | Little | |
| 8,322,570 | B2 | 12/2012 | Beavis et al. | |
| 8,584,900 | B2 | 11/2013 | Metropulos et al. | |
| 8,631,974 | B2 | 1/2014 | Piatnik et al. | |
| 8,783,513 | B2 * | 7/2014 | Beavis | A47J 31/36 222/129.1 |
| 8,798,799 | B2 | 8/2014 | Deo et al. | |
| 8,839,989 | B2 | 9/2014 | Beavis et al. | |
| 8,893,927 | B2 | 11/2014 | Olson et al. | |
| 9,260,283 | B2 * | 2/2016 | Minica | B67D 1/0085 |
| 2002/0083730 | A1 | 7/2002 | Giroux et al. | |
| 2006/0157504 | A1 | 7/2006 | Barker et al. | |
| 2006/0196886 | A1 | 9/2006 | Fox | |
| 2009/0014464 | A1 * | 1/2009 | Adbelmoteleb | B08B 9/032 222/1 |
| 2009/0095771 | A1 | 4/2009 | Hoover | |
| 2009/0120958 | A1 | 5/2009 | Landers et al. | |
| 2012/0230148 | A1 * | 9/2012 | van Opstal | B01F 7/00216 366/167.1 |
| 2012/0285329 | A1 | 11/2012 | Verhoeven et al. | |
| 2013/0206793 | A1 | 8/2013 | Minica et al. | |
| 2014/0069953 | A1 | 3/2014 | Metropulos et al. | |
| 2014/0114469 | A1 | 4/2014 | Givens et al. | |
| 2014/0166053 | A1 * | 6/2014 | Carson | B67D 1/07 134/22.11 |
| 2014/0372233 | A1 | 12/2014 | Knecht et al. | |
| 2015/0017297 | A1 | 1/2015 | Vastardis et al. | |

FOREIGN PATENT DOCUMENTS

| | | | |
|---|---|---|---|
| WO | 2007087611 | A1 | 8/2007 |
| WO | 2014062915 | A2 | 4/2014 |

* cited by examiner

MULTIPLE FLAVOR BEVERAGE DISPENSER

CROSS-REFERENCE TO RELATED APPLICATION

The present application claims priority of U.S. Provisional Patent Application No. 62/145,954, filed on Apr. 10, 2015, the content of which is hereby incorporated herein by reference in its entirety.

BACKGROUND

The present disclosure is related to the field of beverage dispensing. More specifically, the present disclosure is related to the dispense of multiple beverages.

Beverage dispensers may be operated by either customers or food service providers. Available beverage dispensers enable custom and/or prescribed addition of flavor to beverages. These dispensers are commonly used with post-mix beverages where a diluent of still or carbonated water is mixed with a flavored syrup. Additional bonus flavors may be added during or after this mixing process to produce the custom and/or prescribed beverage.

U.S. Pat. No. 7,878,370, which is commonly owned by the Applicant and incorporated by reference herein in its entirety, discloses an alcoholic beverage dispenser with additive injection.

U.S. Pat. No. 8,167,173 discloses a multi-stream draught beer dispensing system that uses a manually operable mechanical valve to select between multiple sources, yet relies upon self draining of the common faucet.

Such systems are limited in the dispense of multiple premixed beverages with the addition of bonus flavors as the premixed beverages leave behind flavor, residue, or other cross-contamination in all commonly used components of the dispenser. These problems are not experienced when still or carbonated water are the diluent. Therefore, new multiple flavor dispensers are desired to address these problems.

BRIEF DISCLOSURE

An exemplary embodiment of a beverage dispenser includes a dispenser body. The dispenser body includes a beverage inlet, a purge inlet, an outlet, and a flow path. The flow path connects the beverage inlet, the purge inlet, and the outlet. The beverage valve is connected to the dispenser body by the beverage inlet. The beverage valve is selectively operable to control a flow of a base beverage through the beverage inlet into the flow path. A purge valve is connected to the dispenser body at the purge inlet. The purge valve is selectively operable to control a flow of a purge substance through the purge inlet into the flow path. A flavor inlet is connected to the dispenser body. The flavor inlet is connected to a flavoring nozzle of the dispenser body. A nozzle is secured to the dispenser body about the outlet and the flavor nozzle of the flavor body. The nozzle is configured to mix a flavoring from the flavoring nozzle with a base beverage from the outlet prior to dispensing a mixture of the flavoring and the base beverage form the nozzle.

An exemplary embodiment of a beverage dispensing system includes a control operable to execute software to receive inputs and provide control outputs based upon the received inputs and executed software. A user interface is operable by the controller to prompt the use to provide at least on input selecting a base beverage and at least one flavoring. A dispenser body includes a beverage inlet, a purge inlet, an outlet, and a flow path. The flow path connects the beverage inlet, the purge inlet, and the outlet. A beverage valve is connected to the dispenser body at the beverage inlet. The beverage valve is selectively operable by the controller in response to the at least one use input selecting the base beverage to control flow of the base beverage through the beverage inlet to the flow path. A purge valve is connected to the dispenser body by the purge inlet. The purge valve is selectively operable to control a flow of a purge substance through the purge inlet into the flow path. A flavor inlet is connected to the dispenser body. The flavor inlet is connected to a flavor nozzle of the dispenser body. A flavor source is connected to the flavor inlet. The flavor source is selectively operable by the controller in response to the at least one user input selecting the at least one flavoring to control a flow of the flavoring from the flavor source through the flavor inlet. A nozzle is secured to the dispenser body about the outlet and the flavor nozzle of the dispenser body. The nozzle is configured to mix a flavoring from the flavoring nozzle with a base beverage from the outlet prior to dispensing a mixture of the flavoring and the base beverage form the nozzle.

An exemplary embodiment of a method of dispensing flavored beverages includes receiving a beverage order at a controller. The beverage order is received through a user input and includes at least one premixed base beverage and at least one flavoring. A first beverage valve is operated to dispense a first premixed base beverage through a flow path in a dispenser body into a nozzle of a dispenser. At least one flavor source is operated to dispense at least one flavoring into the nozzle of the dispenser. The first premixed base beverage and the at least one flavoring at mixed in the nozzle. The mixed first premixed based beverage and the at least one flavor are dispensed from the nozzle. The first beverage valve and the at least one flavor source are operated to end dispense of the first premixed base beverage and the at least one flavoring. A purge valve is fluidly connected to the flow path. The purge valve is opened to purge the flow path of residual first premixed base beverage and at least one flavoring with a purge substance. The purge valve is close to end the purge with the purge substance.

BRIEF DESCRIPTION OF THE DRAWINGS

Examples are described with reference to the following drawing figures. The same numbers are used throughout the figures to reference like features and components.

DETAILED DESCRIPTION OF THE DRAWINGS

Figure 1:
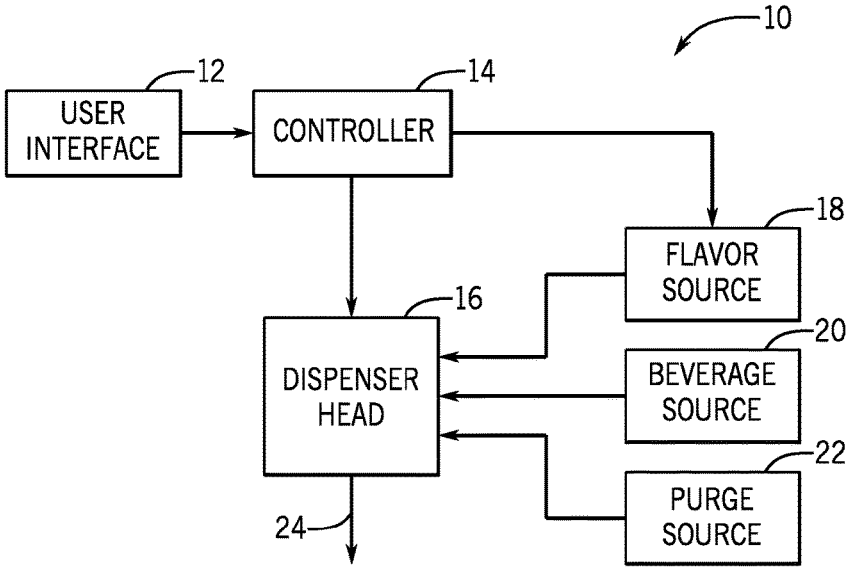
FIG. 1 is a system diagram of a multiple flavor beverage dispensing system.

FIG. 1 depicts an exemplary embodiment of a multiple flavor beverage dispensing system 10. The multiple flavor beverage dispensing system 10 includes a user interface 12 and a controller 14. The user interface 12 is exemplarily a touch screen user interface, and/or a plurality of buttons or levers through which a user may select at least one beverage and at least one bonus flavor. In embodiments, the user interface 12 may further facilitate the user to make a selection of a dispense amount or to initiate and/or stop the dispense of the requested beverage. The controller 14 which may be a processor, microcontroller, or single board computer is communicatively connected to the user interface 12 to receive the user inputs and translate them into signals for operation of components of the system 10. It will be recognized that in embodiments the controller 14 may be implemented with more than one controller in communicative connection with each other to carry out their operations and functions as disclosed herein.

In the present disclosure, the beverage is exemplarily a premixed beverage, meaning that the beverage already contains at least one flavor or additive before it is received at the dispenser head 16 as described herein. In exemplary embodiments, premixed beverages may include beer, which is used as an exemplary embodiment through the rest of the disclosure. Other non-limiting examples of premixed beverages include, but are not limited to hard and soft ciders, brewed iced tea, brewed coffee, or premixed beverages created by mixing still or carbonated water with one or more flavored syrups or powders. In embodiments, the beverages may be branded beverages (e.g. BUDWEISER beer) or may be unbranded (e.g. iced tea or premixed cola).

As used herein, the bonus flavors or flavorings are additives that change the flavor and/or another quality of the beverage to result in the dispensed beverage. Non-limiting embodiments of the flavors include, but are not limited to cherry, lime, strawberry, or vanilla flavored syrups, alcoholic additives such as rum, vodka, or whiskey, or herbal extracts such as basil or mint.

Referring back to FIG. 1, the system 10 includes a flavor source 18. The flavor source 18 may include supplies of each of the flavorings as used within the system 10. In exemplary embodiments used herein, four flavorings are used, but this is in no way limiting on the number of flavorings as may be used within the scope of the present disclosure. In an exemplary embodiment, the controller 14 is communicatively connected to the flavor source 18. The flavor source 18 is operable by the controller 14 to dispense a metered amount of one or more flavorings from the flavoring supplies in the flavor source 18 to the dispenser head 16. In an exemplary and non-limiting embodiment, the flavor source 18 may include one or more metered pumps operable by the controller to provide a specified volume of a selected one or more flavorings over a time period which coincides with the operation of the dispenser head 16 by the controller 14 in accordance with the beverage requested by the user through the user interface 12.

A beverage source 20 supplies the one or more beverages to the dispenser head 16. The purge source 22 supplies a purge substance, which in exemplary and non-limiting embodiments may be air or water, to the dispenser head 16. It will be recognized that each of the flavor source 18, beverage source 20, and purge source 22 may comprise a plurality of supplies of each of these operation inputs to the dispenser head 16. As described above, the flavor source 18 may include multiple flavoring supplies. Similarly, the beverage source 20 may include multiple beverage supplies. In further embodiments, multiple flavors, multiple beverages, or multiple purge substances are provided to the dispenser head 16 and available for user selection in a requested beverage.

The controller 14 receives a requested beverage from the user through the user interface. A requested beverage exemplarily includes a requested base beverage, (which may be a branded beverage), at least one flavoring, and in some embodiments, a dispense size. In response to this beverage request, the controller operates the dispenser head 16 (and in some embodiments the flavor source 18) to provide flows of the requested beverage components in a manner that mixes the components within the dispenser head 16 so that a dispensed beverage 24 is dispensed out of the dispenser head 16 in a uniform or rear uniform color, flavor, and consistency.

Figure 2:
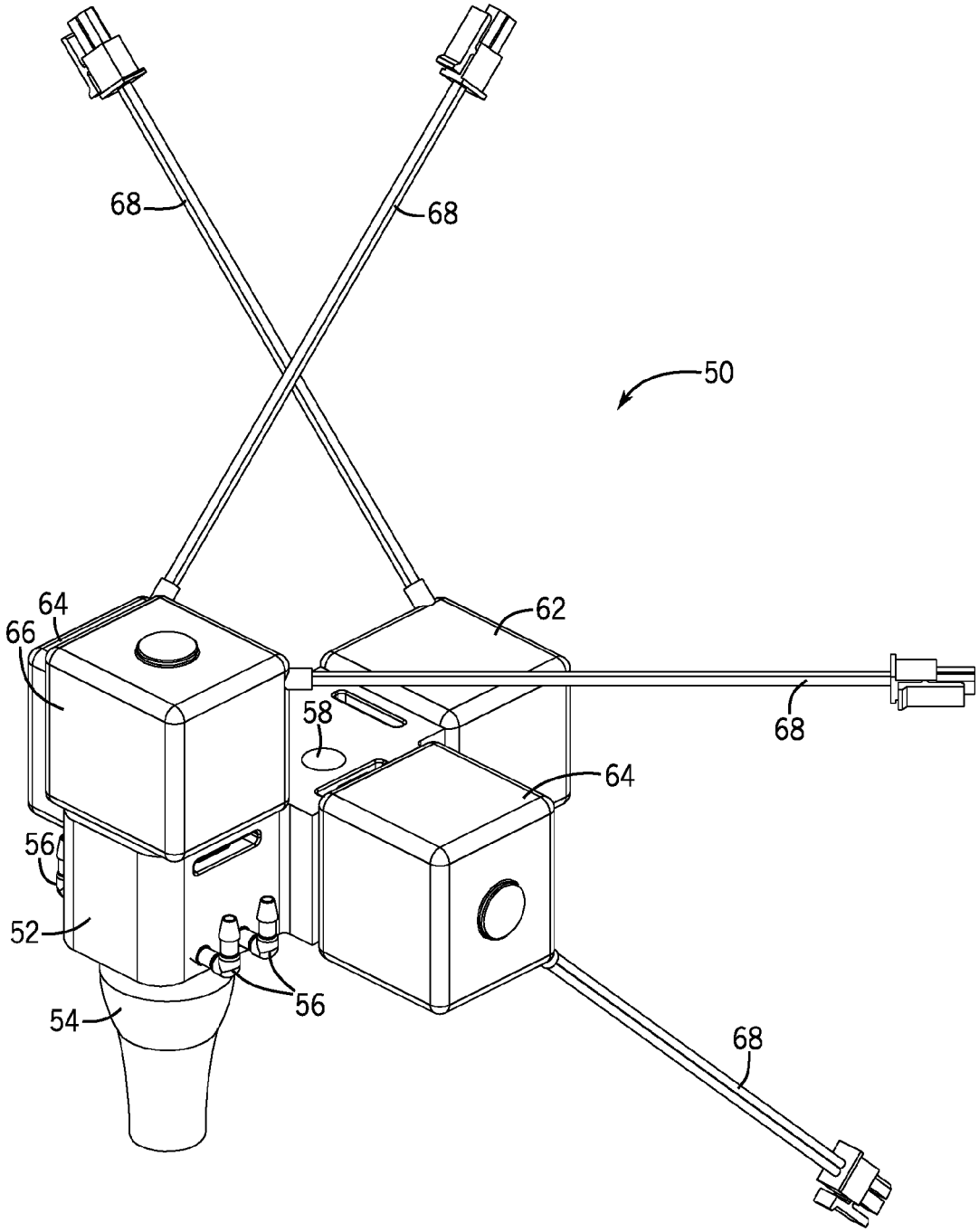
FIG. 2 is a perspective view of an exemplary embodiment of a multiple flavor dispenser head.

FIG. 2 is perspective view of an exemplary embodiment of a dispenser head 50. The dispenser head 50 includes a body 52. As will be described in further detail herein, the body 52 includes flow paths for each of the beverage components as well as any purge substance. In non-limiting embodiments, the body 52 may be machined or cast of a metal material. A nozzle 54 depends from the body 52. The base beverage and at least one bonus flavor are exemplarily mixed in the nozzle 54 and dispensed therefrom as the requested beverage.

Figure 4:
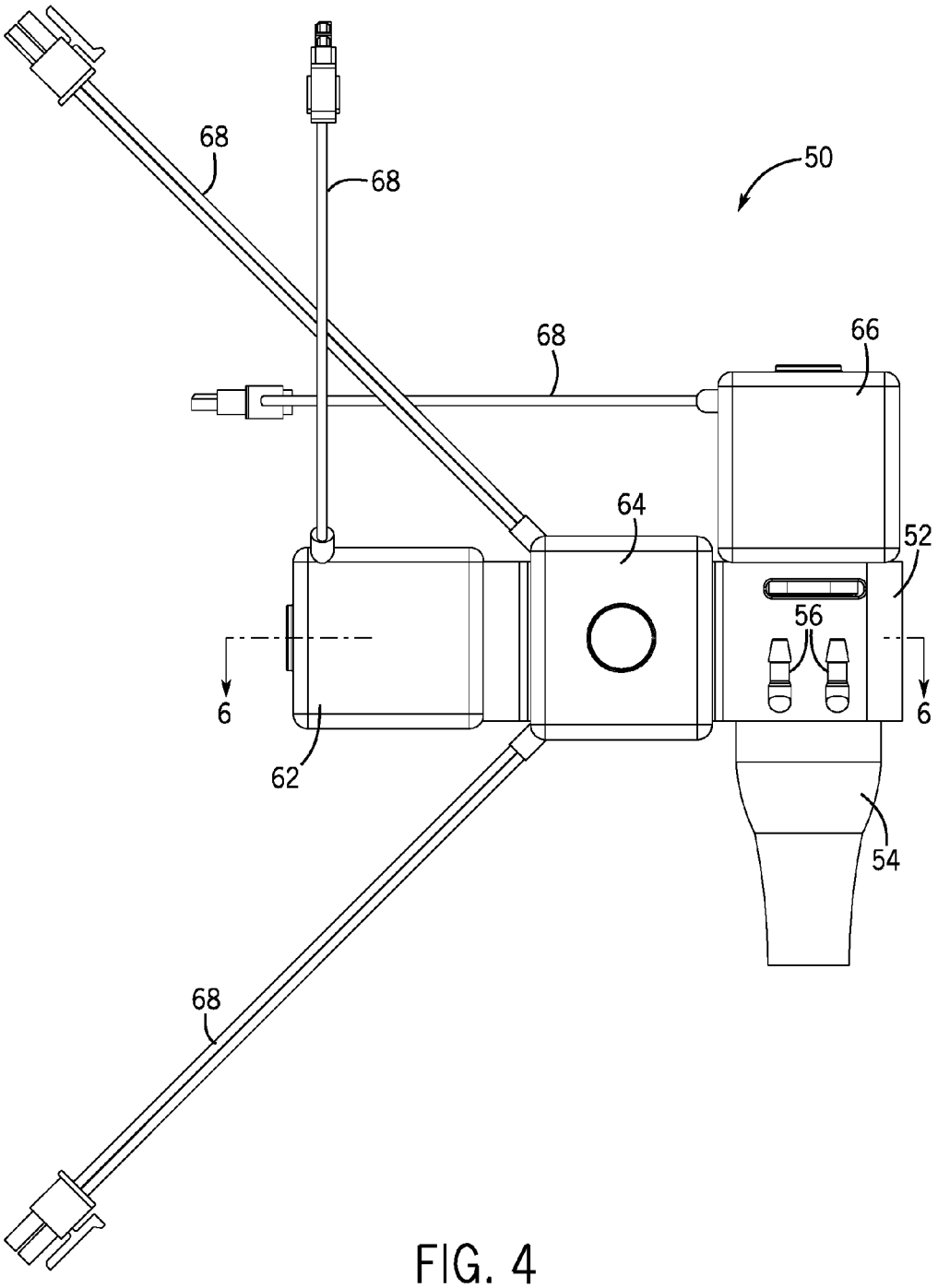
FIG. 4 is a side view of the multiple flavor dispenser head.
Figure 5:
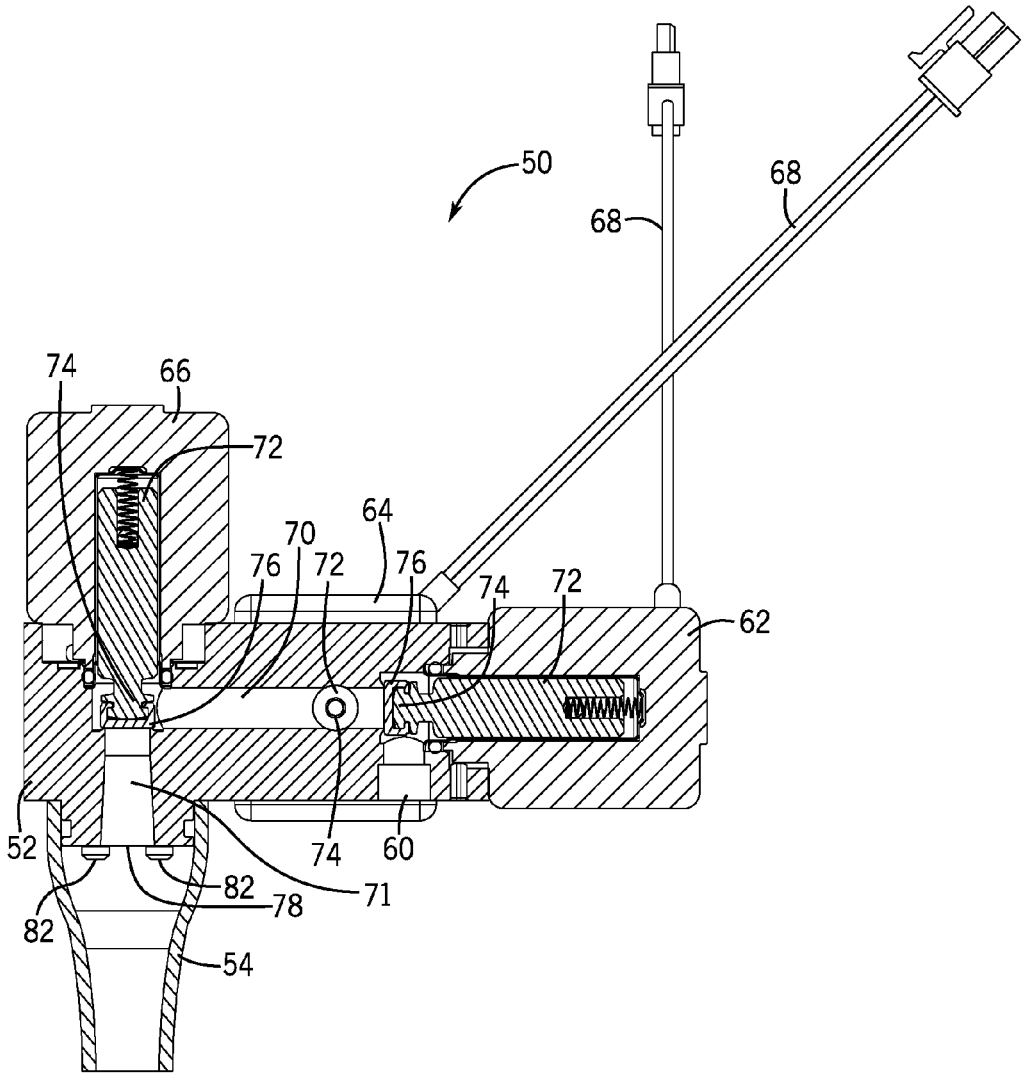
FIG. 5 is a cross-sectional view of the multiple flavor dispenser head as taken along line 5-5 of FIG. 3.

As disclosed in further detail herein, the body 52 includes various inlets for the beverage components/substances received by the dispenser head 50. These include at least one flavor inlet 56, at least one beverage inlet 58, and a purge substance inlet 60 (FIG. 5). In the embodiment depicted in FIGS. 2-7, the dispenser head 50 includes four inlets 56, two beverage inlets 58, and one purge substance inlet 60.

As described in further detail herein, a plurality of valves are connected to the body 52. In exemplary embodiments as disclosed in further detail herein, the valves are solenoid valves, although it will be recognized by a person of ordinary skill in the art that other types of valves may be used, while remaining within the scope of the present disclosure.

The valves exemplarily include a purge valve 62, beverage valves 64, and a flow valve 66. It will be recognized that in an exemplary embodiment, the dispenser head 50 may include a plurality of beverage valves 64 for control of each of the available premixed beverages for the user to select between. The exemplary embodiment depicted in FIGS. 2-7 is configured for use with two beverages. Each of the purge valve 62, beverage valves 64, and flow valve 66 includes a communicative connection 68 which is exemplarily configured to connect to the controller 14 which is depicted and described above with respect to FIG. 1. The communicative connection 68 is exemplarily a wire, and electrical control signals are provided from the controller to the respective solenoids along each communicative connection 68. In some embodiments, it will be recognized that, as described above, an intermediate controller (not depicted) may be used that converts the digital instructions from a processor into electronic signals for operation of the solenoids. It will further be recognized that in other embodiments, the communicative connection 68 may be embodied as a wireless communicative connection, for example, but not limited to using WIFI or BLUETOOTH communication protocols.

Figure 3:
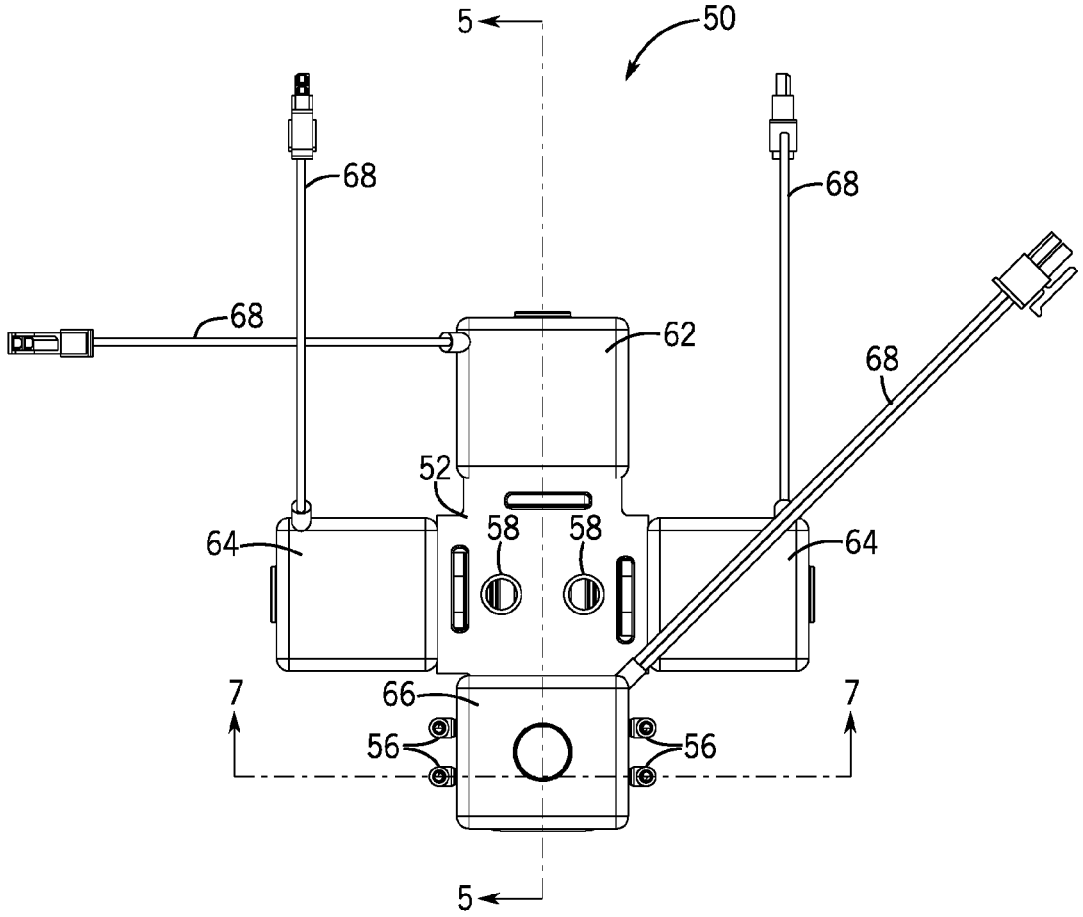
FIG. 3 is a top view of the multiple flavor dispenser head.

FIG. 3 is a top view of the dispenser head 50. FIG. 4 is a side view of the dispenser head 50. FIG. 3 further depicts both beverage inlets 58. In an embodiment, each beverage inlet 58 is associated with a respective beverage valve 64 and the respective beverage valve 64 operates to control flow of the beverage through the respective inlet 58.

Figure 6:
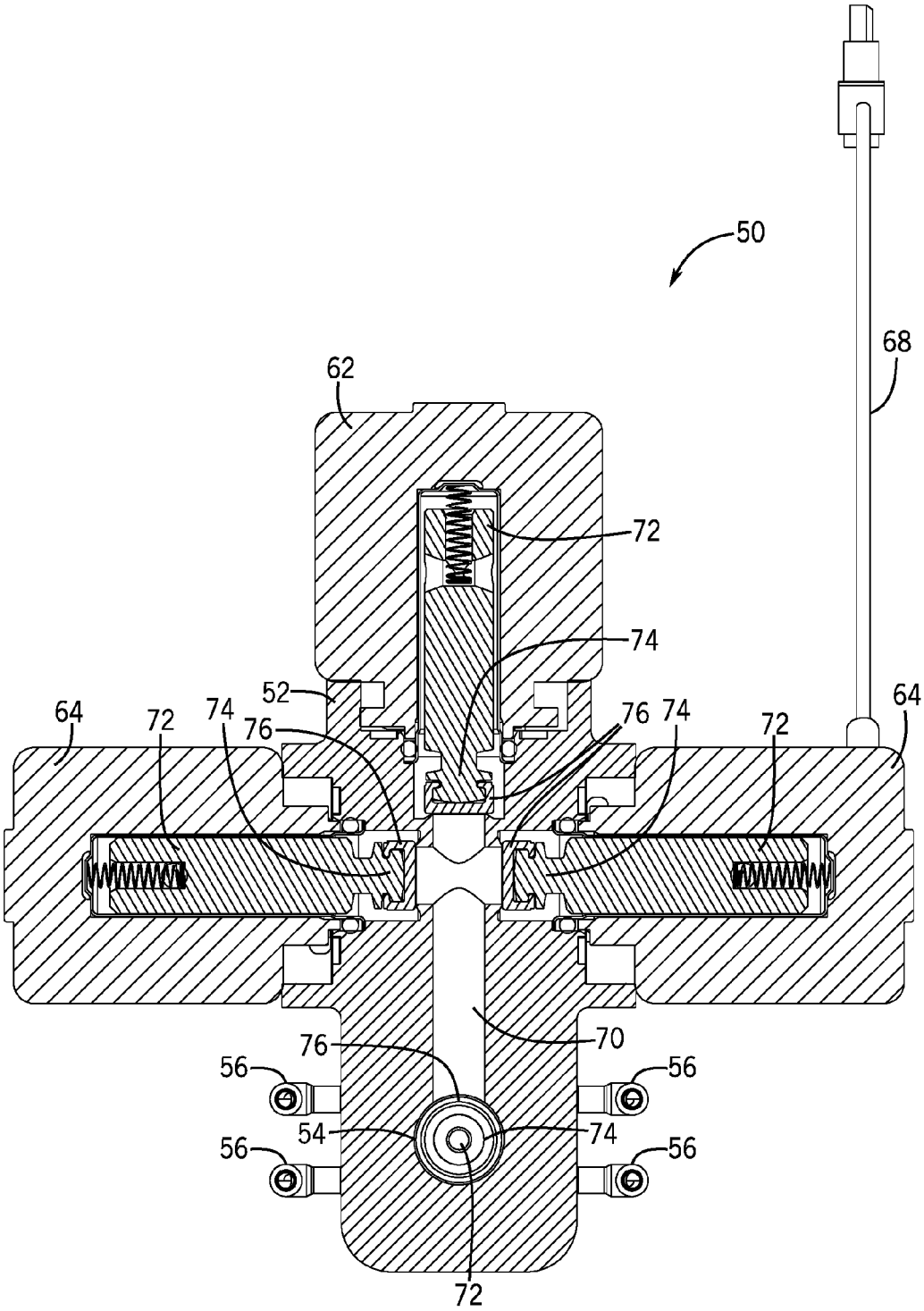
FIG. 6 is a cross-sectional view of the multiple flavor dispenser head as taken along line 6-6 of FIG. 4.
Figure 7:
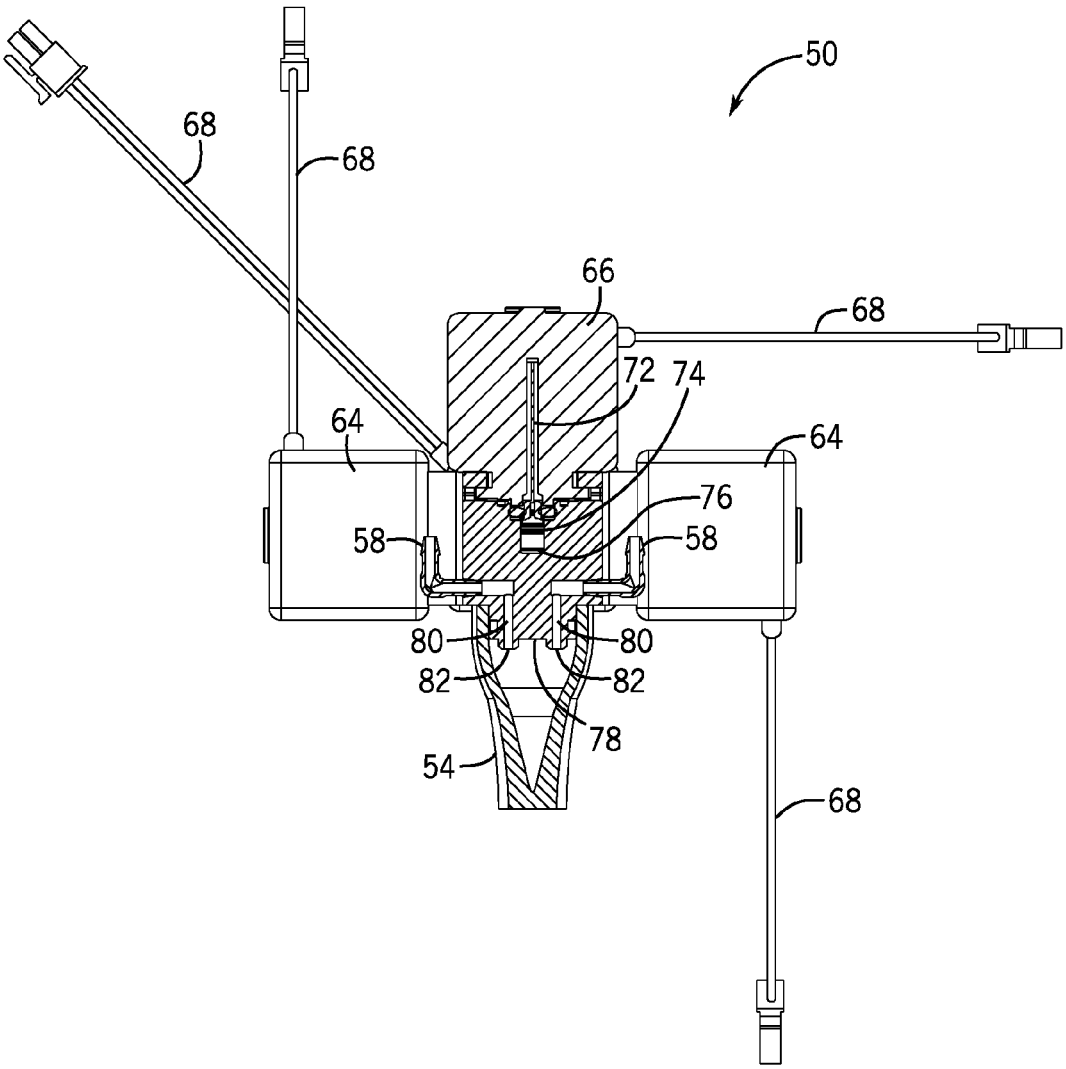
FIG. 7 is a cross-sectional view of the multiple flavor dispenser head as taken along line 7-7 of FIG. 3.

FIG. 5 is a cross-sectional view of the dispenser head 50 taken along line 5-5 of FIG. 3. FIG. 6 is a cross-sectional view of the dispenser head 50 taken along line 6-6 of FIG. 4. FIG. 7 is a cross-sectional view of the dispenser head 50 taken along line 7-7 of FIG. 3. The description herein will be with respect to FIGS. 5-7 which best depict the flow paths within the body 52, as well as the operation of the dispenser head 50. The cross-sectional view of FIG. 5 depicts each of the flavor inlet 56, beverage inlet 58, and purge substance inlet 60 into the body 52. The body 52 also includes a main flow path 70. The main flow path 70 is exemplarily separated from a depending flow path 71 by the flow valve 66. The beverage inlet 58 and the purge substance inlet 60 are fluidly connected to the main flow path 70, but for the selective obstruction of the purge substance inlet by the purge valve 62 and the selective obstruction of the beverage inlets 58 by the beverage valves 64.

Exemplarily, each of the valves (e.g. purge valve 62, beverage valve 64, flow valve 66), when implemented as solenoid valves include a solenoid cylinder 72 and a solenoid head 74. Energization of the solenoid cylinder 72 draws the solenoid head 74 out of contact with a respective valve seat 76 to open fluid communication therethrough. Selective actuation of the purge valve 62, beverage valves 64, and the flow valve 66 selectively control the fluid flow through the body 52. Operation of the flow valve 66 controls flow of the beverage and/or purge substance from the main flow path 70, into the depending flow path 71 and through the outlet 78 into the nozzle 54. It has been recognized by the inventors that in embodiments, an advantage may be achieved in the dispense of premixed beverages, particularly premixed carbonated beverages (e.g. beer), to first open the beverage valve 64 to fill the main flow path 70 up to the closed flow valve 66 for a short time before opening the flow valve 66 to dispense the beverage out of the depending flow path 71 and nozzle 54 as this has been found by the inventors in embodiments to reduce foaming of carbonated beverages when dispensed.

The flavor inlets 56 enter the body 52. Channels 80 extend through the body 52 between each of the flavor inlets 56 and flavor nozzle 82 directed into the nozzle 54. In embodiments, the flavor nozzles 82 may dispense the flavor into the stream of beverage provided through the outlet 78. In embodiments, the flavor nozzles 82 may be configured to either direct the flavor in a manner so as to promote mixing with the stream of beverage. In embodiments, this direction may either be angled into the center of the stream of beverage or in another embodiment be angled away from the stream of the beverage towards the sides of the nozzle 54. In a still further embodiment, the flavor nozzle 82 may produce a spray or aerate the flavoring to further facilitate mixture.

Figure 8:
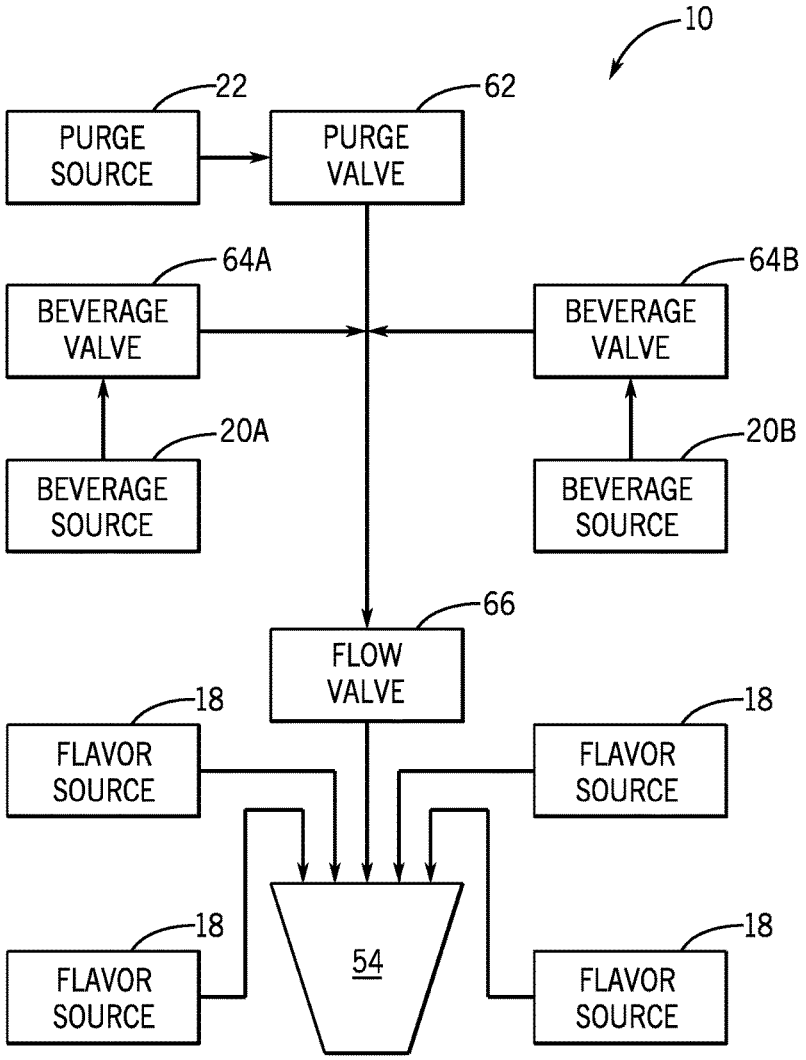
FIG. 8 is an additional system diagram of an exemplary embodiment of a multiple flavor beverage dispenser system.

FIG. 8 is a system diagram that depicts an exemplary embodiment of a multiple flavor beverage dispensing system 10. The system diagram of FIG. 8 highlights the flow paths within the multiple flavor beverage dispensing system 10. It will be recognized that similar numbers from the description above have been used to indicate like components from that description. In the embodiment of the system 10, depicted in FIG. 8, the multiple flavor beverage dispensing system 10 exemplarily provides a user with a choice between two base beverages and four flavorings. In exemplary embodiments, the beverage sources 20A, 20B may be kegs of beer. In one embodiment, the beers may be of different brands (e.g. BUDWEISER and MILLER) while in another embodiment, the two beverage sources 20A, 20B may represent two kegs of different beer. Exemplarily beverage source 20A is a keg of lager beer and beverage source 20B is a keg of light lager beer. The flow of the lager beer from the beverage source 20A into the dispenser head 50 (FIGS. 5-7) is selectively controlled by beverage valve 64A. The flow of the light lager beer into the dispenser head 50 is selectively controlled by beverage valve 64B. Further details regarding the operation of embodiments will be apparent through the following description of an exemplary use of the multiple flavor beverage dispensing system 10.

In this example, two base beverages are available including a lager and a light lager, while four flavorings are available including e.g. cherry, lime, strawberry, and an alcoholic additive of whiskey. A user operates the user interface 12 (FIG. 1) to select the dispense of the lager beer with the addition of lime flavoring and whiskey. The controller 14 (FIG. 1) operates the beverage valve 64A associated with the lager beer to open a flow of the lager beer into the main flow path 70 in the dispenser head 50 (FIGS. 5-7) after a short delay enabling the main flow path 70 to fill and/or the lager beer to settle in the main flow path 70, the flow valve 66 is operated by the controller to open, releasing the lager beer through the depending flow path 71 and into the nozzle 54. The appropriate lime and whiskey flavor sources are operated to dispense an amount of these flavorings into the nozzle 54 simultaneously with the flow of the lager beer through the nozzle 54. In embodiments, preset volumes of the flavorings may be used, a predetermined volume relative to a selected dispense size may be used, a predetermined flow rate may be used throughout the entirety of a beverage dispense, or a user may be presented with an ability to select between various flavoring concentrations and volume. The lager beer, the lime flavor, and the whiskey are combined and mixed in the nozzle 54 and are dispensed therefrom as a single uniform stream of the requested beverage.

In an embodiment, if a user selected a dispense of a particular volume, the system 10 may operate to stop the dispense of the beverage at the requested volume. In an alternative embodiment, the user may actuate a dispense button and press and/or hold the dispense button for a length of time of a desired dispense. The dispense stops upon the user's release of the button. In either event, when dispense stops, the flavor sources are controlled to end dispense of the flavoring and the respective beverage solenoid is closed to cut off the flow of the lager. At this point the purge valve 62 is opened to connect the purge source 22 to the flow path. In this example the purge source 22 is a cylinder of pressurized air. Opening of the purge valve 62 enables the purge substance of air to flow through the main flow path 70 to purge any remaining lager beer out of the main flow path 70, flow valve 66, depending flow path 71, or nozzle 54 and into the glass with the rest of the dispensed beverage. The flow of air also purges any residual flavoring out of the nozzle 54 along with the purged lager beer. After the purge process, the purge valve 62 is closed and the multiple flavor beverage dispensing system 10 is ready for a subsequent dispense.

Another exemplary embodiment may be carried out without the flow valve 66. In such embodiments, particularly by those in which the base beverages are not carbonated, the operation of the beverage valves 64 control the flow of the base beverage into the nozzle 54. Operation of the purge valve 62 remains the same to clear any base beverage from the flow path and nozzle 54 after the beverage valve 64 is closed.

The process above is advantageous in that a subsequent dispense involves a request for a dispense of solely light lager beer, this requested beverage has a more delicate flavor that may be impacted by any residual amounts of lager beer, or any of the additional flavorings. Therefore, for consistency and quality between dispenses, the system 10 is able to purge these sources of cross-contamination.

Figure 9:
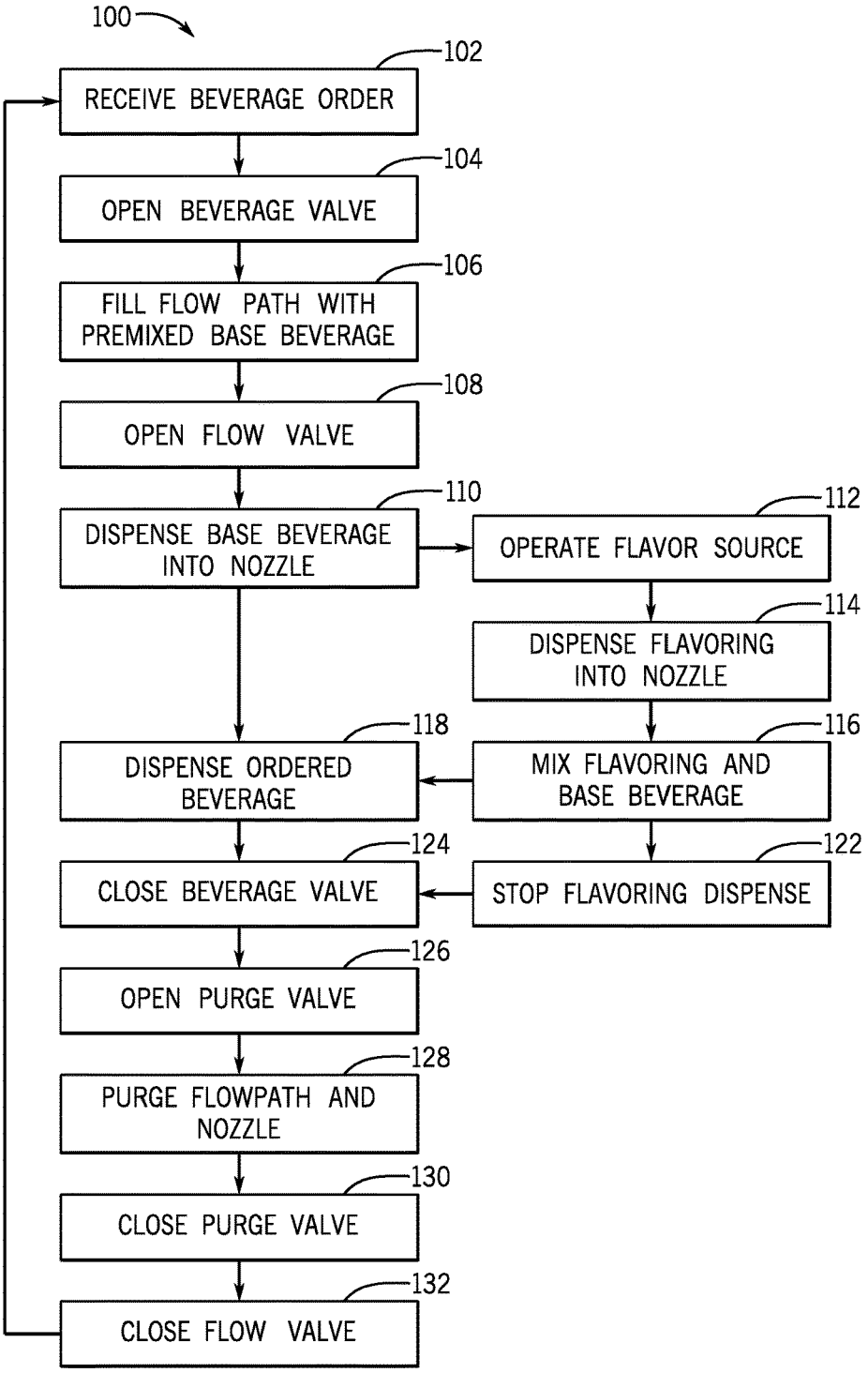
FIG. 9 is a flow chart that depicts an exemplary embodiment of a method dispensing beverages.

FIG. 9 is a flow chart that depicts an exemplary embodiment of a method 100 of dispensing beverages. The method 100 begins at 102 where a beverage order is received. A beverage order is exemplarily received through one or more user inputs, exemplarily to a touch sensitive user interface. The beverage order exemplarily includes a selection of a premixed base beverage and one or more flavoring. It will be recognized that in embodiments, a user may place a beverage order that includes no additional flavorings and thus function related to the dispense of the flavorings may be optional in the method.

At 104 a beverage valve is opened. The opened beverage valve is associated with the base beverage of the ordered beverage. As previously mentioned, the base beverage is a premixed beverage which may include, but is not limited to brewed beverages such as beer, coffee, iced tea, hard cider, root beer, or premixed combinations of a diluent and a flavoring powder or syrup.

Upon opening the beverage valve at 104, the base beverage flows from the beverage source through the beverage valve, and at 106 fills a flow path within the dispenser head with the premixed base beverage. In embodiments that include a flow valve, such flow valve may occlude the flow path such that the base beverage is accumulated in the flow path. In such embodiments, particular advantage in the dispense of carbonated base beverages has been observed as this priming of the dispenser head has been found to reduce foaming in the dispensed beverage. After the base beverage has been held in the flow path, the flow valve is opened at 108. Opening of the flow valve 108 opens the flow path to flow of the base beverage from the beverage source through the dispenser head to dispense the base beverage into the nozzle at 110.

As mentioned above, the beverage order received at 102 may include the selection of one or more flavorings to be added to the base beverage in the dispense. If one or more flavorings have been selected then, at 112 at least one flavor source is operated which results in dispensing the flavoring into the nozzle at 114. In exemplary embodiments, the flavoring may be dispensed from flavoring sources through the use of pumps under operational control by the controller. In exemplary embodiments, the flavor sources are operated such that the dispense of the flavoring into the nozzle at 114 is coordinated to the dispense of the base beverage into the nozzle at 110. In embodiments in which a flavoring is included in the ordered beverage at 116 the flavoring and the base beverage mix within the nozzle of the dispenser. The mixing of the base beverage and the flavoring within the nozzle results in a stream of the ordered beverage dispensed out of the nozzle at 118 that is uniform in color, composition, and flavor.

Next, at 122, in embodiments in which flavoring is dispensed, the flavoring dispense is stopped and the beverage valve is closed at 124. In this embodiment, stopping the flavoring dispense shortly before the beverage valve is closed, helps to promote fluxion of the flavoring from the nozzle with the last dispensed amount of the base beverage.

After the beverage valve is closed at 124, a purge valve is opened at 126. The purge valve is fluidly connected between a purge source and one end of the flow path such that when the purge valve is opened at 126 the purged substance is provided under pressure from the purge source through the flow path and the nozzle to clear the flow path and nozzle of any residual base beverage and flavoring that may remain therein. In exemplary embodiments, the purge source may be pressurized air. Although in other embodiments, the purge substance may be another gas such as, but not limited to, carbon dioxide or nitrogen or a liquid such as water. The purged substance flows through the flow path and nozzle and purges the flow path and nozzle at 128 of any residual base beverage or flavoring. After this the purge valve is closed at 130 ending the purge of the flow path and nozzle and the flow valve is closed at 132. Closing of the flow valve at 132 closes the partially purged flow path from outside sources of contamination. The system is now ready to dispense a newly received beverage order in a manner in which the new beverage order will be free of flavor, color, other composition contamination from the substances of the previously dispensed beverage order.

Furthermore, as distinguished from post-mix beverage systems with water (still or carbonated) as the diluent, it is undesirable to leave residual beverage (e.g. lager beer) in the flow path, particularly if there is a long time duration until a next dispense. Depending upon the setting within which the dispenser is used, this may be a manner of hours or days; for example over night or over a weekend.

Figure 10:
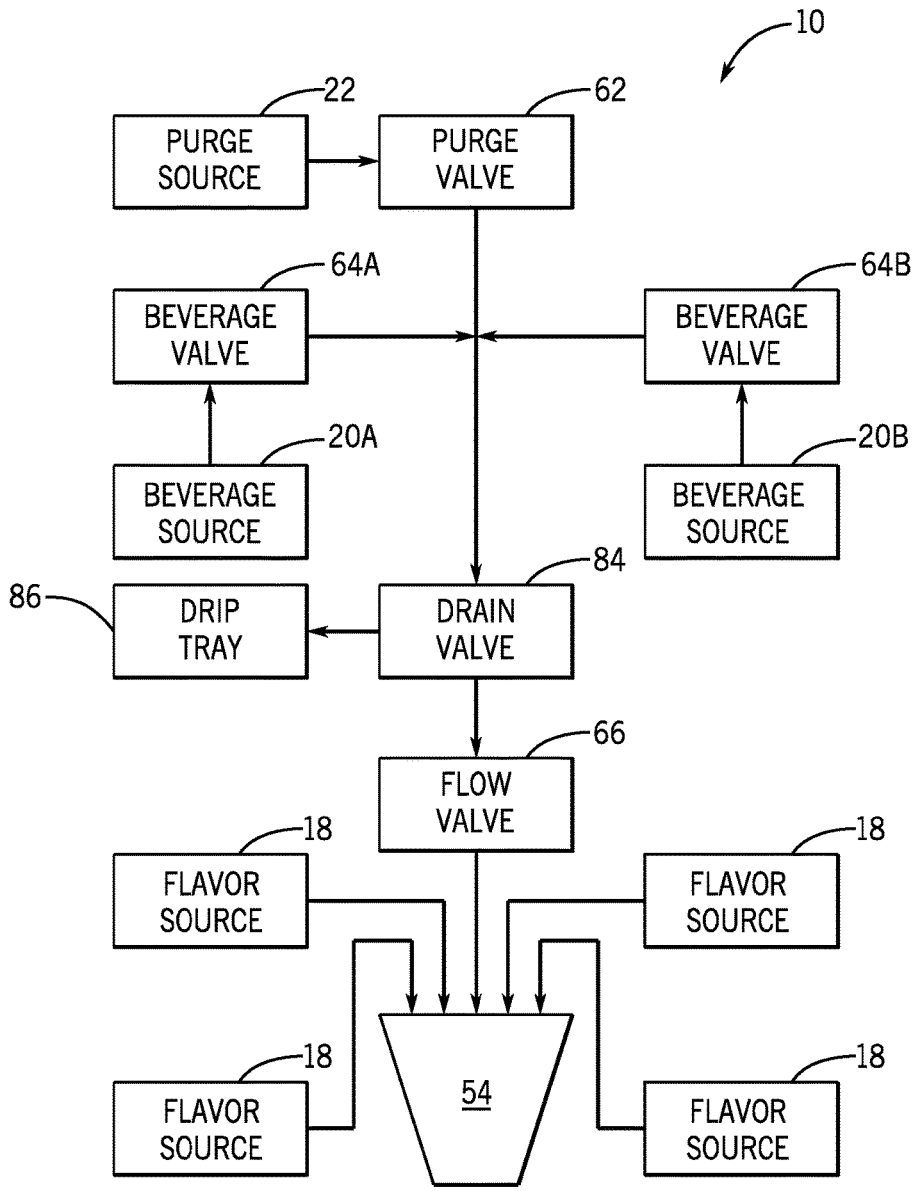
FIG. 10 is a system diagram of an additional exemplary embodiment of a multiple flavor beverage dispenser system.

FIG. 10 is a system diagram of an additional exemplary embodiment of a multiple flavor beverage dispenser system 10. The system 10 depicted in FIG. 10 further includes a drain valve 84 exemplarily disposed in the flow path between the beverage valve 64A, beverage valve 64B, and purge valve 62 on one side and the flow valve 66 on the other. The drain valve 84 may exemplarily be a solenoid valve as described above or may be another type of valve as would be recognized by a person of ordinary skill in the art. The drain valve 84 may be operated by the controller (FIG. 1) as described above. In an embodiment, the drain valve 84 operates in a first configuration wherein the drain valve 84 permits fluid flow therethrough between either of the beverage valves 64A, 64B and the flow valve 66. The drain valve 84 is operable in a second configuration wherein the drain valve 84 occludes flow to the flow valve 66 and instead diverts flow entering the drain valve 84 exemplarily to a drip tray 86. In embodiments of the system 10, the drip tray 86 may further be connected to a utility sewer line of the facility I which the system 10 is installed.

In operation, the system depicted in FIG. 10 may operate in a similar manner as described above with respect to the method 100 of FIG. 9. The drain valve 84 begins the method in the closed configuration that permits fluid flow between the beverage valves 64A, 64B, and the flow valve 66. The system is operated otherwise the same as described above with respect to FIG. 9 to dispense the selected base beverage with additional flavor. Upon completion or near completion of the dispense of the ordered beverage, the flavoring dispense is stopped first, which as described above at 112 and FIG. 9. Next, as described above at 124, the beverage valve remains open for a short time after the flavoring dispense has stopped in order to clear any remaining flavoring to of the nozzle with the base beverage. After this cleaning, the beverage valve is closed.

Additionally in the operation of the system of FIG. 10, the flow valve 66 is also closed at this time. The drain valve 84 is then opened such as to occlude flow to the flow valve 66 and to open flow to the drip tray 86. The purge valve 62 is opened and the purge substance flows through the flow path to the drain valve 84, displacing any remaining base beverage out of the flow path of the dispenser head through the drain valve 84 and into the drip tray 86. The purge valve 62 is then closed followed by the drain valve 84. This operation clears the dispenser head of the base beverage and the system is ready for a subsequent dispense of an ordered multiple flavor beverage.

In additional embodiments, the flow valve 66 and the drain valve 84 may be implemented as a single three-way valve. For example, the combined flow valve 66 and drain valve 84 may have three positions (e.g. occluded, flow to the nozzle 54, and flow to the drip tray 86). The combined flow valve and drain valve may be operated between the three positions by the controller as described above. In still further embodiments, the drain valve 84 may be located between the flow valve 66 and the nozzle 54, or, as described above, the flow valve 66 may be absent from the system and only the drain valve 84 used.

In the present Description, certain terms have been used for brevity, clearness and understanding. No unnecessary limitations are to be implied therefrom beyond the requirement of the prior art because such terms are used for descriptive purposes only and are intended to be broadly construed. The different embodiments described herein may be used alone or in combination with other apparatuses, systems and methods. Various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A beverage dispenser comprising:

a dispenser body comprising a beverage inlet, a purge inlet, an outlet, and a flow path connecting the beverage inlet, the purge inlet, and the outlet;

a beverage valve connected to the dispenser body at the beverage inlet, the beverage valve being selectively operable to control a flow of a base beverage through the beverage inlet into the flow path;

a flavor inlet connected to the dispenser body, the flavor inlet connected to a flavor nozzle of the dispenser body;

a nozzle secured to the dispenser body about the outlet and the flavor nozzle of the dispenser body, the nozzle configured to mix a flavoring from the flavoring nozzle with a base beverage from the outlet prior to dispensing a mixture of the flavoring and the base beverage from the nozzle;

a controller operable to execute software to receive inputs and provide control outputs to at least the beverage valve based upon the received inputs and executed software; and a flow valve connected to the dispenser body in the flow path, the flow valve selectively operable to occlude the flow path;

wherein the controller is configured such that the beverage valve opens while the flow valve is closed to fill the flow path with the base beverage before the flow valve is opened to dispense the base beverage to the nozzle for mixing with the flavoring.

2. The beverage dispenser of claim 1, wherein the base beverage is a premixed beverage.

3. The beverage dispenser of claim 1, wherein the flavor inlet is comprised in a plurality of flavor inlets and the flavor nozzle is comprised in a plurality of flavor nozzles, and each flavor inlet of the plurality of flavor inlets is connected to a flavor nozzle of the plurality of flavor nozzles.

4. The beverage dispenser of claim 3, wherein each of the plurality of flavor nozzles are oriented in a direction towards a dispense stream of the outlet.

5. The beverage dispenser of claim 1, further comprising a purge valve connected to the dispenser body at the purge inlet, the purge valve selectively operable to control a flow of a purge substance through the purge inlet into the flow path.

6. The beverage dispenser of claim 5, wherein the dispense of the base beverage is ended by closing the beverage valve, followed by opening the purge valve to purge the flow path and nozzle with the purge substance, after the purge valve is closed, the flow valve is closed.

7. The beverage dispenser of claim 5, wherein the beverage valve, the purge valve, and the flow valve are each solenoid valves.

8. The beverage dispenser of claim 5, wherein the beverage inlet is a first beverage inlet, the beverage valve is a first beverage valve, and the base beverage is a first base beverage, and further comprising:

a second beverage inlet in the dispenser body and a second beverage valve connected to the second beverage inlet, the second beverage valve being selectively operable to control a flow of a second base beverage through the second beverage inlet into the flow path.

9. The beverage dispenser of claim 8, wherein the first beverage valve is closed to end the dispense of the first base beverage, then the purge valve is opened and closed to purge the flow path and the nozzle with the purge substance, then the second beverage valve is operated to dispense the second base beverage.

10. The beverage dispenser of claim 5, further comprising a drain valve connected to the dispenser body along the flow path between the beverage valve and the nozzle, wherein the drain valve is operated in coordination with the purge valve to divert the purge substance out of the flow path.

11. A beverage dispensing system comprising:

a controller operable to execute software to receive inputs and provide control outputs based upon the received inputs and executed software;

a user interface operable by the controller to prompt the user to provide at least one input selecting a base beverage and at least one flavoring;

a dispenser body comprising a beverage inlet, a purge inlet, an outlet, and a flow path connecting the beverage inlet, the purge inlet, and the outlet;

a beverage valve connected to the dispenser body at the beverage inlet, the beverage valve being selectively operable by the controller in response to the at least one user input selecting the base beverage to control a flow of the base beverage through the beverage inlet into the flow path;

a purge valve connected to the dispenser body at the purge inlet, the purge valve selectively operable to control a flow of a purge substance through the purge inlet into the flow path;

a flavor inlet connected to the dispenser body, the flavor inlet connected to a flavor nozzle of the dispenser body;

a flavor source connected to the flavor inlet, the flavor source being selectively operable by the controller in response to the at least one user input selecting the at least one flavoring to control a flow of the flavoring from the flavor source through the flavor inlet;

a nozzle secured to the dispenser body about the outlet and the flavor nozzle of the dispenser body, the nozzle configured to mix a flavoring from the flavoring nozzle with a base beverage from the outlet prior to dispensing a mixture of the flavoring and the base beverage from the nozzle; and a flow valve connected to the dispenser body in the flow path, the flow valve selectively operable to occlude the flow path;

wherein the controller is configured such that the beverage valve opens while the flow valve is closed to fill the flow path with the base beverage before the flow valve is opened to dispense the base beverage to the nozzle for mixing with the flavoring.

12. The beverage dispenser of claim 11, further comprising a drain valve connected to the dispenser body along the flow path between the beverage valve and the flow valve.

* * * * *